US006363667B2

(12) United States Patent
O'Neill

(10) Patent No.: US 6,363,667 B2
(45) Date of Patent: Apr. 2, 2002

(54) PASSIVE COLLIMATING TUBULAR SKYLIGHT

(76) Inventor: Mark O'Neill, 1077 Chisolm Trail, Keller, TX (US) 76248

( * ) Notice: Subject to any disclaimer, the term of this patent is extended or adjusted under 35 U.S.C. 154(b) by 0 days.

(21) Appl. No.: 09/740,797

(22) Filed: Dec. 21, 2000

Related U.S. Application Data

(63) Continuation-in-part of application No. 09/271,466, filed on Mar. 18, 1999, now abandoned.

(51) Int. Cl.[7] ..... E04B 7/18
(52) U.S. Cl. ..... 52/200; 359/597; 359/641
(58) Field of Search ..... 52/200, 173.3; 359/591, 597, 641

(56) References Cited

U.S. PATENT DOCUMENTS

| | | | | | |
|---|---|---|---|---|---|
| 191,802 | A | * | 6/1877 | Howard | 52/200 |
| 3,137,099 | A | * | 6/1964 | Wasserman | 52/200 X |
| 3,350,819 | A | | 11/1967 | Polidoro | |
| 3,511,559 | A | | 5/1970 | Foster | |
| 3,839,949 | A | * | 10/1974 | Gobel | 52/200 X |
| 4,339,900 | A | * | 7/1982 | Freeman | 52/200 |
| 4,733,505 | A | * | 3/1988 | Van Dame | 52/200 X |
| 4,809,468 | A | * | 3/1989 | Bareiss | 52/200 X |
| 5,502,935 | A | | 4/1996 | Demmer | |
| 5,528,471 | A | | 6/1996 | Green | |
| 5,546,712 | A | * | 8/1996 | Bixby | 52/200 |
| 5,613,333 | A | * | 3/1997 | Witzig, Jr. | 52/200 |
| 5,655,339 | A | * | 8/1997 | DeBlock et al. | 52/200 |
| 5,729,387 | A | | 3/1998 | Takahashi | |
| 6,035,593 | A | * | 3/2000 | Chao et al. | 52/200 |
| 6,219,977 | B1 | * | 4/2001 | Chao et al. | 52/200 |

FOREIGN PATENT DOCUMENTS

| | | | | |
|---|---|---|---|---|
| DE | 2142873 | * | 3/1973 | 52/200 |
| EP | 628676 | * | 12/1994 | 52/200 |
| FR | 2637929 | * | 4/1990 | 52/200 |
| GB | 9046 | * | of 1908 | 359/597 |
| JP | 4-323451 | * | 11/1992 | 52/200 |
| SU | 647424 | * | 2/1979 | 52/200 |
| WO | WO-94/06979 | * | 3/1994 | 52/200 |

* cited by examiner

*Primary Examiner*—Laura A. Callo
(74) *Attorney, Agent, or Firm*—Sankey & Luck L.L.P.

(57) ABSTRACT

A passive collimating tubular skylight consisting of a radiant energy-collecting aperture, a radiant energy-delivering aperture, and a radiant energy passageway between these two apertures, the passageway having a specularly reflective interior surface and a configuration to improve the collimation of the radiant energy passing therethrough. The skylight can be configured with the radiant energy-collecting aperture located above the roof of a building, oriented to collect sunlight; and equipped with a sealed weatherproof glazing, with the radiant energy-delivering aperture, or luminaire, located at ceiling level within the building, and equipped with a diffusing glazing; and with the reflective tubular light passageway constructed with a larger cross sectional area near the radiant energy-delivering aperture than near the radiant energy-collecting aperture. In complete accord with the second law of thermodynamics, and as proven by experimental results, the new passive collimating tubular skylight provides significant advantages over the prior art, including better solar energy collection, higher throughput optical efficiency, improved radiant energy collimation, enhanced interior illumination levels, and more precise positional control of the interior illumination.

27 Claims, 6 Drawing Sheets

Side

Improved

All 40° Incidence
11
Top
Isometric
9
Max 26° Emergence
Front
Side
11

Fig. 4 A
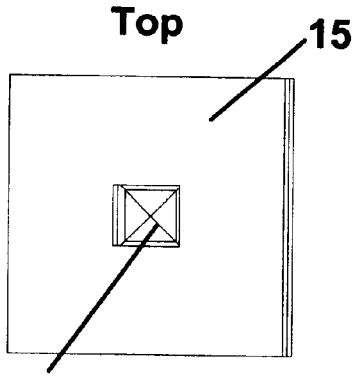
Fig. 4 D
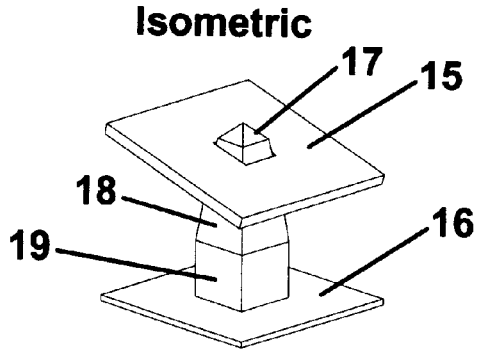
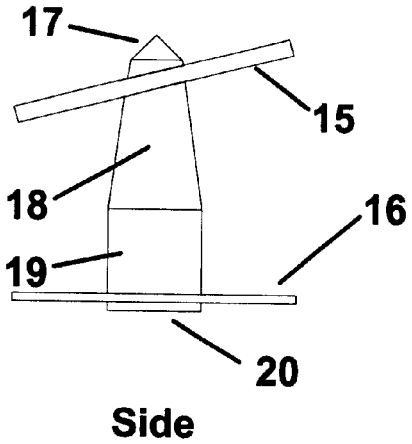
Fig. 4 B
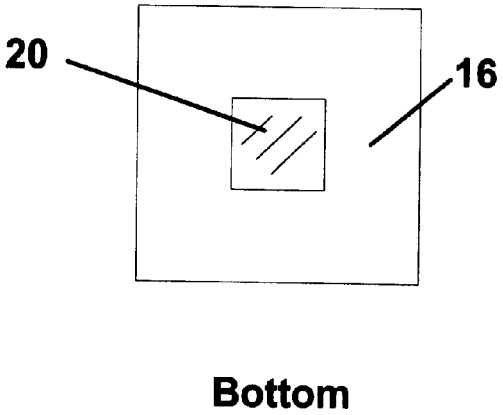
Fig. 4 C

PASSIVE COLLIMATING TUBULAR SKYLIGHT

CROSS REFERENCE TO RELATED APPLICATIONS

The present application is a continuation-in-part of application Ser. No. 09/271,466 as filed on Mar. 18, 1999, the disclosure of which is herein incorporated by reference.

BACKGROUND—FIELD OF INVENTION

The present invention relates generally to skylights, and more particularly to tubular skylights, which use an enclosed hollow passageway, or light tunnel, to convey the sunlight from the energy-collecting aperture (or skylight) on the roof, to the energy-delivering aperture (or luminaire) inside the building. The present invention further relates to a passive skylight, with no moving parts, as opposed to an active skylight, with sun-tracking reflectors or lenses.

BACKGROUND—DESCRIPTION OF PRIOR ART

Mass-produced passive tubular skylights are becoming increasingly popular due to their relatively low cost, compared to conventional skylights, which use expensive frame-and-plasterboard construction of the light passageway from the energy-collecting aperture to the interior of the room. However, neither the prior art tubular skylight nor the conventional skylight is very effective in providing good illumination, throughout the entire day, in the room area just beneath the skylight, because of the highly variable angles of incidence of the rays of solar radiation intercepting the energy-collecting aperture.

Prior art passive tubular skylights and conventional skylights with tubular features have been the subjects of patents for more than 80 years. In U.S. Pat. No. 1,254,520, MacDuff describes a passive tubular skylight with numerous prisms and two mirrors located inside the energy-collecting dome on the roof of the building. The apparent purpose of the prisms and mirrors was to collect solar radiation, coming from a variety of directions with various incidence angles at the light-collecting dome, and to collimate and redirect such radiation downward through a light tube, into the interior of the building. As will be shown below, MacDuff's arrangement is not feasible when the second law of thermodynamics is fully considered.

In U.S. Pat. No. 3,511,559, Foster describes a passive tubular skylight similar to MacDuff's device, both using a large roof-mounted dome to collect sunlight from all directions. However, inside the dome, Foster uses a refractive collimator instead of the prisms and mirrors of MacDuff's design. As will be shown below, Foster's refractive collimator is not feasible when the second law of thermodynamics is fully considered.

In U.S. Pat. No. 4,114,186, Dominguez describes a passive tubular skylight with a movable reflective lid at the energy receiving end of the skylight. The lid could be opened to augment energy collection during the day, and closed to prevent energy leakage during the night. No means of collimating the sunlight are described by Dominguez.

In U.S. Pat. No. 4,306,769, Martinet describes a passive tubular skylight similar to MacDuff's device, both using mirrors inside the energy-collecting dome to intercept and redirect incident sunlight. Martinet's light tube is tapered from a relatively large opening near the energy collecting dome to a relatively small and constant opening for the light passageway from exterior roof to interior ceiling. As will be shown below, such a reduction in light tube width or diameter from the energy-capturing aperture to the energy-delivering luminaire is counterproductive in terms of light collimation.

In U.S. Pat. No. 4,733,505, Van Dame describes a passive tubular skylight constructed from a cloth-like fabric coated with reflective material. No means of collimating the sunlight are described by Van Dame.

In U.S. Pat. No. 4,809,468, Bareiss describes a conventional skylight light well constructed from a rolled-up flexible sheeting material to form a tubular light well structure. No mention of reflection, collimation, or other optical function of the skylight is made by Bareiss.

In U.S. Pat. No. 5,099,622, Sutton describes a passive tubular skylight, similar to those described earlier by MacDuff and Martinet, all of which use a reflector inside the energy-collecting dome on the roof of the building. As with the earlier designs, the purpose of Sutton's reflector is to intercept and redirect sunlight downwardly into the light tube. No mention of collimation is made by Sutton.

In U.S. Pat. No. 5,546,712, Bixby describes a passive tubular skylight with improved mounting lips on the tubular sections comprising the light passageway. No mention of collimation is made by Bixby.

In U.S. Pat. No. 5,655,339, DeBlock describes a passive tubular skylight similar to the earlier designs of MacDuff, Martinet, and Sutton, all of which use reflective surfaces inside the energy-collecting dome to intercept and redirect sunlight downwardly into the light passageway. DeBlock's reflector is a prismatic device molded into the dome itself No mention of collimation is made by DeBlock.

While not directly applicable to the present invention, other inventors have described active sun-tracking mirrors or lenses to provide downward collimation of sunlight into skylights. For example, in U.S. Pat. No. 4,883,340, Dominguez describes an active sun-tracking set of slatted mirrors for directing sunlight into a skylight. Similarly, in U.S. Pat. No. 5,729,387, Takahashi et al. describe an active, sun-tracking set of prismatic lenses for directing sunlight into a skylight.

SUMMARY OF THE INVENTION

As summarized above, the art contains many approaches to passive tubular skylights and to conventional skylights with tubular features. However, none of the prior devices disclosed in the art include practical means for collimating the collected sunlight so that it may be delivered to the desired location within the room below throughout the entire day. Indeed, prior passive tubular skylights which recognize the need for such collimation, including those illustrated in patents issued to MacDuff, Foster, and Martinet, present configurations which cannot provide such collimation because of a fundamental physical principle, as set forth in the second law of thermodynamics. The other prior skylights do not recognize or address the need for such collimation.

The present invention relates to an improved passive tubular skylight configured to collimate and deliver the collected sunlight to the desired area of the room directly beneath the luminaire, throughout the entire day. In a general embodiment, the skylight of the present invention comprises an energy-collecting aperture, an energy-delivering aperture and a specularly reflective light passageway disposed between said energy-collecting and energy-delivering apertures. The light passageway includes a specularly reflective collimating section which has a first cross-sectional area $A_1$ for accepting light from the energy-collecting aperture and a second cross sectional area $A_2$ for delivering light to said energy-delivering aperture. In a preferred embodiment, $A_2$ is at least fifteen percent larger than $A_1$.

The present invention is a purely passive collimating tubular skylight, which avoids the complexity, cost, and reliability disadvantages of all of the active skylight approaches.

Accordingly, several objects and advantages of the invention are to provide improved passive tubular skylights, said improved skylights providing better overall optical performance than prior art skylights. Other objects and advantages of the invention include improved passive tubular skylights, said improved skylights providing better collimation of the collected sunlight.

Other objects and advantages of the invention include improved passive tubular skylights, said improved skylights providing better all-day illumination in the desired working area beneath the skylight. Still further objects and advantages of the invention include improved passive tubular skylights, said improved skylights providing better throughput optical efficiency. Still further objects and advantages of the invention include improved passive tubular skylights, said improved skylights providing better light distribution within the interior space of the building.

Still further objects and advantages will become apparent from a consideration of the ensuing description and accompanying drawings.

BRIEF DESCRIPTION OF THE DRAWINGS

FIGS. 4A–4D comprise a set of three orthogonal views (FIGS. 4A–4C) and one isometric view (FIG. 4D) of one embodiment of the invention, including its relationship to the external roof and interior ceiling of a building.

DETAILED DESCRIPTION OF THE PREFERRED EMBODIMENT

The skylight system of the present invention generally comprises at least one radiant energy-collecting aperture, at least one radiant energy-delivering aperture, and at least one radiant energy passageway between said radiant energy-collecting and radiant energy-delivering apertures, said passageway having at least a portion of its interior surface reflective to said radiant energy. The said passageway is configured to improve the collimation of said radiant energy while said energy is being transferred from said radiant energy-collecting aperture to said radiant energy-delivering aperture.

Figure 1:
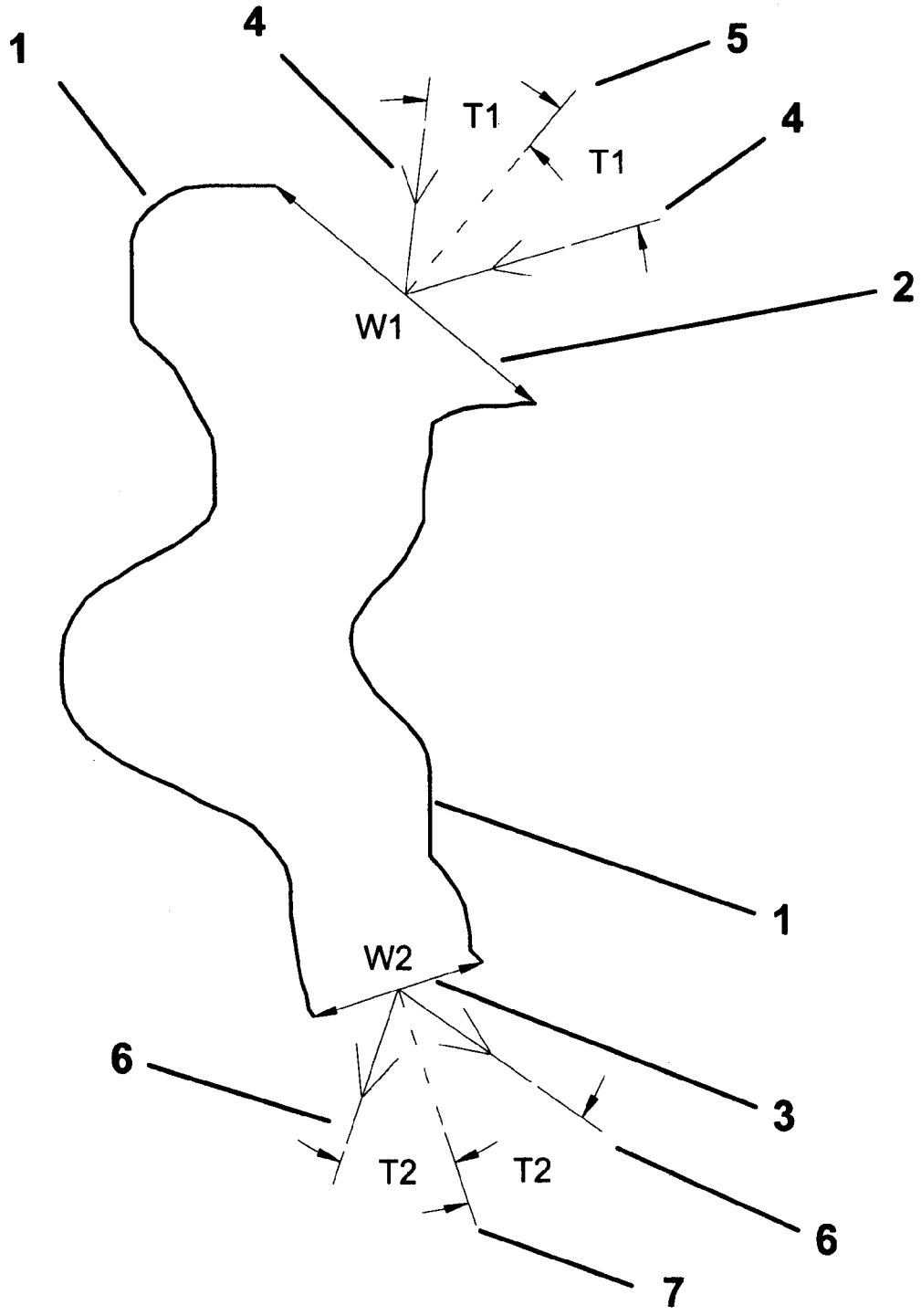
FIG. 1 comprises a schematic illustration showing the simplified cross section of a generalized tubular skylight, to define the geometrical terms in the mathematical relationship dictated by the second law of thermodynamics.

To illustrate a fundamental physical limitation of all such devices, FIG. 1 shows a highly generalized passive tubular skylight 1 which includes one radiant energy-collecting aperture 2, having an opening width $W_1$, and one radiant energy-delivering aperture 3, having an opening width $W_2$. Incident rays of radiant energy, including the limiting rays 4, are contained within a maximum incidence angle value of $T_1$, relative to a vector 5 which is normal to the energy-collecting aperture 2. Thus, the incident rays 4 of radiant energy have the largest incidence angles of any rays being collected by the tubular skylight. Emerging rays of radiant energy, including the limiting rays 6, are contained within a maximum emergence angle of $T_2$, relative to a vector 7 which is normal to the energy-delivering aperture 3. Thus, the emerging rays 6 of radiant energy have the largest emergence angles of any rays being delivered by the tubular skylight.

It is well known to those of ordinary skill in the art of optical concentration that the second law of thermodynamics places an upper bound on the achievable amount of concentration, or focusing, of radiant energy. This upper bound precludes the possibility of concentrating the incident radiant energy into a focus which is brighter than a source of radiant energy of an angular extent corresponding to the upper limit of ray incidence angles. By reference to FIG. 1, a thermodynamically ideal optical concentrator would be able to concentrate all of the rays 4 intercepting the width $W_1$ of the energy-collecting aperture 2 into a focus with a width no smaller than $W_1 \sin(T_1)$. Similarly, a thermodynamically ideal optical concentrator would be able to concentrate all of the rays 6 leaving the width $W_2$ of the energy-delivering aperture 3 into a focus with a width no smaller than $W_2 \sin(T_2)$. For a perfectly reflective ideal tubular skylight, the radiant power at the energy-delivering aperture 3 would equal the radiant power at the energy-collecting aperture 2. Since the combination of the generalized tubular skylight 1 and an ideal concentrator located at the energy-delivering aperture 3 can be considered a single optical concentration system, the second law of thermodynamics will not allow this combination to produce a focus which is brighter than the focus produced by an ideal concentrator at the energy-collecting aperture 2. Therefore, considering the potentially equal radiant powers at both apertures, the latter focus width, $W_2 \sin(T_2)$, must be as wide as, or wider than, the former focus width, $W_1 \sin(T_1)$. Thus, the second law of thermodynamics for a passive tubular skylight can be expressed by the inequality:

$$\frac{W2}{W1} \geq \frac{\sin(T1)}{\sin(T2)}$$

This inequality leads to several important conclusions regarding the previously discussed prior art. Clearly, it is impossible for a passive tubular skylight to collect all of the radiant energy contained in a wide incidence angle range, $T_1$, and to collimate it into a narrower emergence angle range, $T_2$, unless the energy-delivering aperture width, $W_2$, is larger than the energy-collecting aperture width, $W_1$. Therefore, the collimation means discussed by MacDuff, Foster, and Martinet cannot be realized in a physical skylight. Indeed, all three of these prior art patents show skylight systems with radiant energy-collecting apertures larger than the radiant energy-delivering tubes. As discussed above, the second law of thermodynamics requires that this geometrical configuration must result in reduced collimation instead of the desired improved collimation.

The second law inequality presented above further implies that the only possibility of improving the collimation of radiant energy passing through a passive tubular skylight is for the energy-delivering aperture to be wider than the energy-collecting aperture. Also, this inequality shows that the greater the ratio of entry to exit aperture widths, the greater the potential for improved collimation. However, this rationale in no way describes the configuration of the skylight between the energy-collecting and energy-delivering apertures to effect such improved collimation. The following discussion will present several new passive tubular skylight embodiments which provide such collimation, without violating the second law of thermodynamics.

Figure 2A:
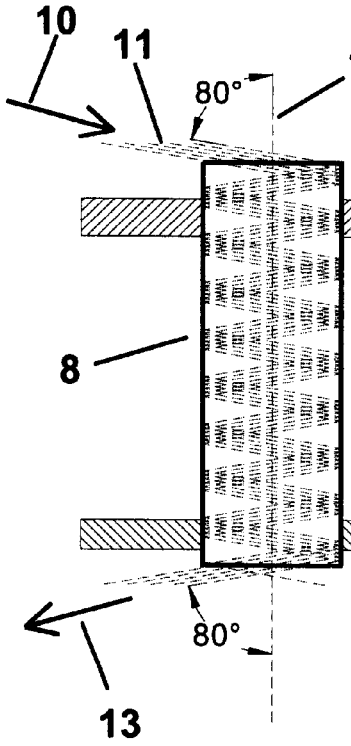
Fig. 2 A Prior Art
FIGS. 2A–2B comprise a schematic illustration showing and contrasting the simplified cross sections of both a prior art tubular skylight (FIG. 2A) and one embodiment of the improved tubular skylight of the present invention (FIG. 2B), both including solar ray trace diagrams.
Figure 2B:
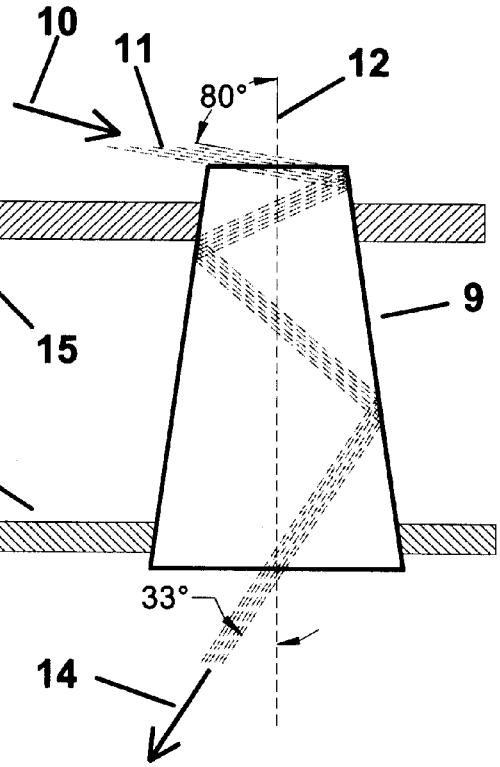
Figures 3A, 3B, 3C, 3D:
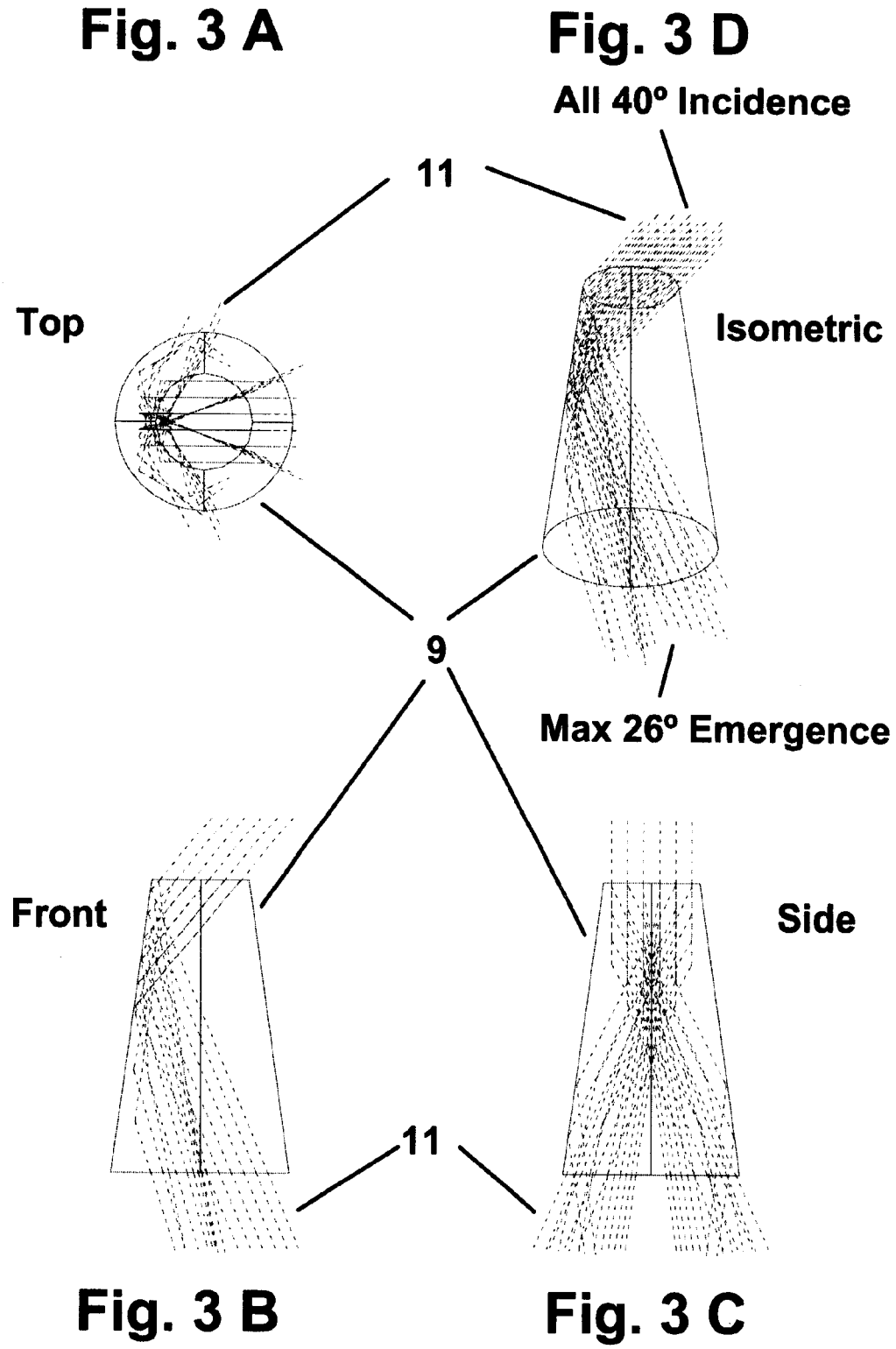
FIGS. 3A–3D comprise a set of three orthogonal views (FIGS. 3A–3C)and one isometric view (FIG. 3D) of one embodiment of the improved tubular skylight of the present invention, all views including solar ray trace diagrams.

FIGS. 2A–2B compare an exemplary prior art passive tubular skylight 8 with the simplest embodiment of the new passive collimating tubular skylight 9. In FIGS. 2A–2B, each skylight is shown in a simplified, two-dimensional view corresponding to a cross section which includes the optical and geometrical centerline of the skylight. This cross-sectional view is intentionally general, being applicable to a variety of three-dimensional skylight shapes, including round or rectangular in the orthogonal cross section perpendicular to the optical and geometrical centerline of the skylight.

The upper cross-hatched structure 15 represents a building roof, while the lower cross-hatched structure 16 represents the ceiling of a room inside the building.

Each skylight in FIGS. 2A–2B has a length which is three times as large as the energy-collecting aperture width. Both skylights have specularly reflecting interior surfaces. Solar rays traveling in the direction shown by the arrows 10 intercept the energy-collecting apertures at the tops of both skylights. These parallel rays 11 of sunlight are traced with dashed lines. These traced rays 11 have an incidence angle of 80 degrees relative to the centerlines 12 of both skylights, said centerlines also being normal to the energy-collecting apertures of the skylights.

In the prior art skylight 8 illustrated in FIG. 2A, the rays 11 undergo seventeen reflections before emerging from the energy-delivering aperture at the bottom of the skylight. Even for an excellent reflector material, with a specular reflectance value of 90%, less than 17% of the incident solar radiation would survive the seventeen reflections and exit the bottom of the skylight in the direction shown by the arrow 13. Furthermore, the angle of emergence is 80 degrees for the prior art skylight 8, such that no light is delivered directly below the skylight for this realistic set of early morning or late afternoon conditions.

In contrast, the improved passive collimating tubular skylight 9 illustrated in FIG. 2B uses a specially flared or tapered interior reflective surface to collimate the incident. solar rays 11. At each of three reflections, the solar rays 11 are further collimated, until they emerge from the energy-delivering aperture in the direction shown by arrow 14, corresponding to an emergence angle of 33 degrees. For the same reflectance value of 90%, 73% of the incident solar radiation would exit the bottom of the skylight. This efficiency is more than four times as high a throughput optical efficiency as for the prior art skylight illustrated in FIG. 2A. Furthermore, the skylight illustrated in FIG. 2B directs the emerging solar rays to the region beneath the skylight, with only a 33 degree emergence angle. It should be noted that the new skylight 9 not only delivers more light than the prior art skylight, but also delivers such light more directly to the interior space beneath the skylight, where illumination is desired.

The configuration of the collimating tubular skylight illustrated in FIG. 2 was selected after performing two-dimensional ray trace analyses of various candidate designs for rays of various incidence angles. The selected configuration provides excellent collimation for incidence angles from zero to 90 degrees, with angles of emergence less than 40 degrees for the full range of incidence angles. The selected configuration also corresponds to a 30 cm (12 inch) energy-collecting aperture, a 56 cm (22 inch) energy-delivering aperture, and a 91 cm (36 inch) tube length between the apertures.

While not shown in FIGS. 2A–2B, both the prior art skylight 8 and the improved skylight 9 would generally have a weatherable glazing on the exterior energy-collecting aperture, and a luminaire diffuser glazing on the interior energy-delivering aperture. Also, both skylights would generally have weather-tight flashings and sealants at the roof penetration and attractive luminaire frames at the ceiling penetration. These features are not illustrated in FIGS. 2A–2B, which is meant to illustrate the basic optical configuration and inherent performance advantages of the new passive collimating tubular skylight.

FIG. 2B shows only the lengthwise cross section, which includes the optical centerline, of the improved collimating tubular skylight 9. Many different tube geometries share this same cross section, and all are considered to be embodiments of the present invention. For example, tube 9 could have a passageway cross section which is circular or square or hexagonal or rectangular or elliptical. FIGS. 3A–3D show three orthogonal views (FIGS. 3A–3C) and one perspective view (FIG. 3D) of one of these candidate geometries, which corresponds to a circular conical tubular geometry for the improved skylight 9. FIG. 2B also shows a solar ray trace diagram for a number of solar rays 11 which are incident at an angle of 40 degrees on the small energy-collecting circular aperture at the top of the skylight. After reflecting one or more times from the interior surface of the cone, where the surface is coated with a specularly reflecting material, all of the rays exit the large energy-delivering circular aperture at the bottom of the skylight. These exiting rays all have emergence angles of 26 degrees or less, indicating that the collimation of the sunlight has been dramatically improved compared to the 40 degree incidence angle for all of the rays entering the top aperture.

The lengthwise cross-sectional geometry of the conical reflective tube 9 illustrated in FIGS. 3A–3D is identical to the two-dimensional geometry of tube 9 in FIG. 2B. Comparing the ray traces for these two figures shows that this configuration provides good collimation for incoming solar rays with incidence angles of both 40 degrees and 80 degrees. Indeed this particular configuration was selected after performing a number of ray trace analyses for incidence angles from 0 degrees to 90 degrees. Three-dimensional ray trace analyses were performed for both round and square skylight passageways, having the same lengthwise cross-sectional geometry. In all cases, the selected configuration provides excellent improvement in collimation.

FIGS. 4A–4D present several views of one preferred embodiment of the new passive collimating tubular skylight. Consistent with the general embodiment illustrated in FIG.

2B, the new tubular skylight penetrates both the external roof 15 of a building and the internal ceiling 16 of one of the rooms in the building. An energy-collecting aperture 17 is located above the roof structure to intercept solar radiation of both direct and diffuse components. This energy-collecting aperture can take one of many conventional forms, all well known in the skylight art, from a translucent planar window, to a clear pyramidal atrium-type skylight, to a partially transparent, colored plastic, bubble-shaped skylight. For the embodiment shown in FIGS. 4A–4B, this energy-collecting aperture 17 is shown, for example purposes only, as a pyramidal skylight. The energy-collecting aperture 17 is attached to a collimating portion 18 of the tubular skylight. This collimating portion 18 includes a specularly reflecting inner surface, such as Alcoa EVERBRITE 95® lighting sheet, and a tapered shape similar to the tapered tube 9 of FIG. 2B. Specifically, the collimating portion 18 of FIGS. 4A–4D has a 12 inch square (30 cm square) opening at its top, and a 22 inch square (56 cm square) opening at its bottom, while its tubular length is 36 inches (91 cm) from top to bottom. A non-tapered extension portion 19 of the light tube is used to extend the tube from the large end of the collimating portion 18 to the luminaire opening in the ceiling 16. At the lower end of this extension tube 19, a transparent or translucent glazing 20 is used to complete the luminaire, which delivers light to the interior room. Extension tube 19 includes a specularly reflecting inner surface, of the same type and material as the collimating portion 18. The luminaire glazing 20 used to deliver light to the room can include prisms or other surface features to provide a desired amount of diffusion of the delivered light, as well as to minimize glare from the skylight.

While the specific embodiment of the passive collimating tubular skylight of FIGS. 4A–4D is shown to have a square passageway geometry, this feature should in no way be interpreted as a limitation of any kind on the scope of the invention. Indeed, the passageway may adopt many different cross-sectional shapes, including a circular configuration as illustrated in FIGS. 3A–3D, oval, rectangular, hexagonal, octagonal, and many others, and still incorporate the new collimating feature of the present invention. Indeed, the passageway may utilize different configurations between the energy-collecting aperture and the energy-delivering aperture, and still incorporate the new collimating feature of the present invention; for example, the energy-collecting aperture and a portion of the light tube may be round, while a later portion of the light tube and the energy-delivering aperture may be square, with appropriate round-to-square transitions between elements. The optical benefits of the new invention, as demonstrated in the sectional diagram of FIG. 2B, will exist for any conceivable passageway geometry.

The specific embodiments of the collimation tubes shown in FIG. 2B, FIGS. 3A–3D, and FIGS. 4A–4D, should in no way be seen as limiting the scope of the present invention. For example, the reflective walls of the passageway could be curved in the longitudinal direction, instead of linear in this direction, as shown in these figures, while still providing the collimation improvement taught by the invention. Similarly, the simple conical or pyramidal collimator tube geometries of FIGS. 3A–3D and FIGS. 4A–4D, respectively, could be far more complex, while still falling within the scope of the present invention. For example, the straight radiant energy passageways shown in FIG. 2B, 3A–3D, and 4A–4D, could be modified, using elbows and other joints, to form non-linear "zig-zag" passageways, while still falling within the scope of the current invention. In yet another example, a round light tube could transition to a square light tube with the flared collimating portion in either the round or the square tube.

Figure 5A:
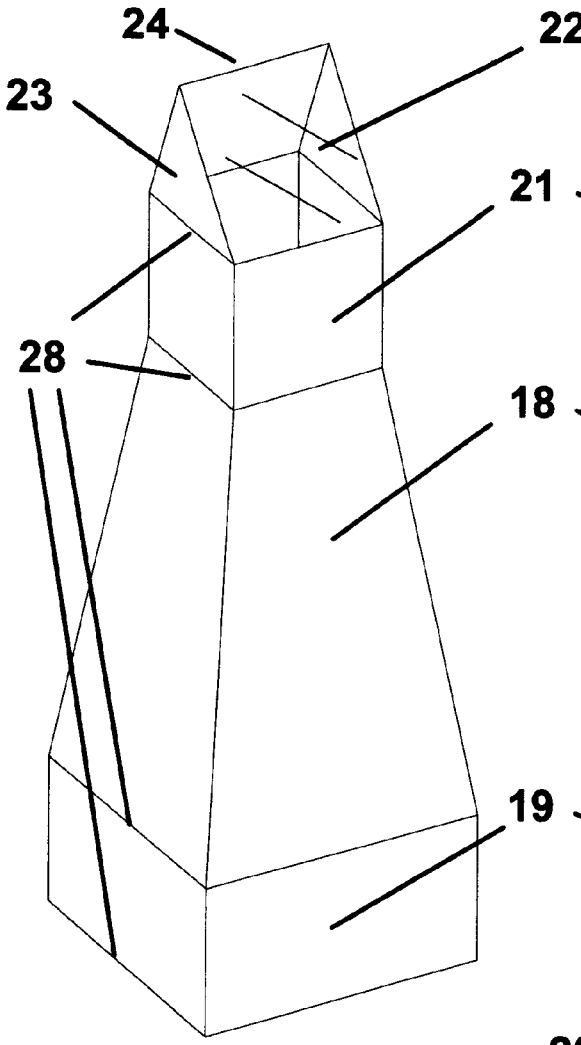
FIGS. 5A–5B comprise a set of two perspective views of another embodiment of the present invention, with one viewpoint showing the energy-collecting aperture, and the other view showing the energy-delivering luminaire aperture (FIG. 5B).
Figure 5B:
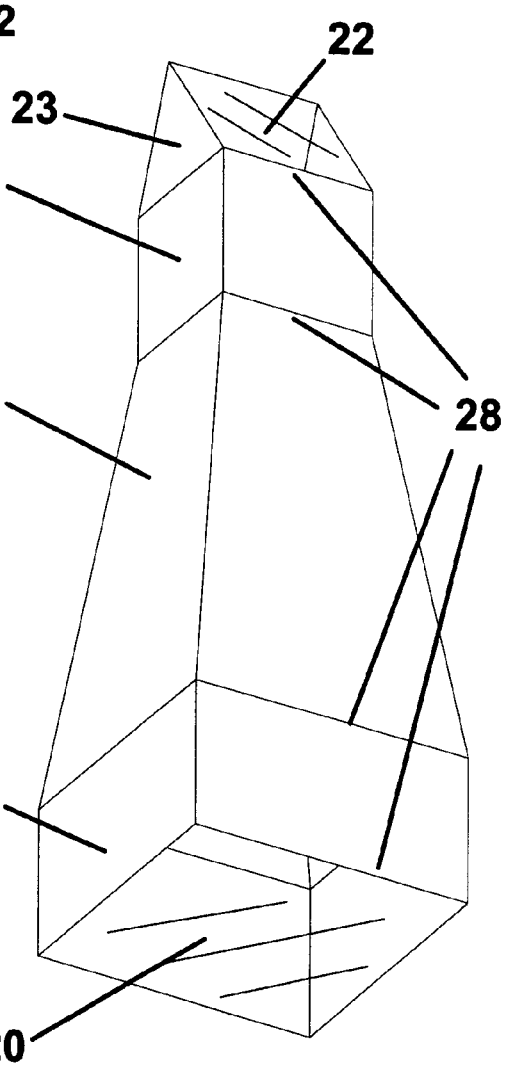

FIGS. 5A–5B present two perspective views of another preferred embodiment of the present invention, with the roof and ceiling structures removed from view to better illustrate the new skylight features. This embodiment is similar to the embodiment shown in FIGS. 4A–4D, with several added elements. The collimation section 18, the large extension section 19, and the radiant energy-delivering aperture 20 in FIGS. 5A–5B retain their same basic form and function as those illustrated in FIGS. 4A–4B. A new small extension section 21 has been added to the top of the collimation tube section, to extend the length of the overall tubular skylight system. It is optically preferable to use a large extension tube 19, rather than a small extension tube 21, since the rays are more collimated after passing through the tapered section 18; therefore, fewer reflections are needed to move a given distance lengthwise through the large extension tube 19 than through the small extension tube 21. However, less reflective material is needed for the small extension tube 21 than for the large extension tube 19, and the smaller unit may be easier to install in certain applications. Therefore, both types of extension tubes, as well as others of similar form and function, are suitable as components of the collimating passive tubular skylight of the present invention. The collimating tube 18 and extension tubes 19 and 21 are sealed against dirt and moisture infiltration by using tape or other sealing means to seal all joints 28 between material elements comprising these tubes.

FIGS. 5A–5B also shows a radiant energy-collecting aperture 22 which is tilted relative to the longitudinal axis of the skylight. This glazed aperture 22 is part of a radiant energy-capturing structure which also includes two triangular side panels 23, and one rectangular back panel 24. To maximize solar energy collection throughout the year, the tilted aperture 22 should be aimed generally toward the south in the northern hemisphere and generally toward the north in the southern hemisphere. In most locations, the aperture 22 tilt angle, measured from the local horizontal, should be about equal to the local latitude plus or minus 10–15 degrees. The back panel 24 of the energy-capturing structure should have a specular reflector on its inner surface, to reflect rays striking said panel downward into the radiant energy passageway, which includes the collimating portion 18 and either or both of the extension tubes 19 and 21, as required. The triangular side panels 23 of the energy-capturing structure can also use a specular reflector on their interior surfaces. A preferred configuration of the energy-capturing structure includes an aperture 22 tilt angle equal to the local latitude angle plus or minus 10–15 degrees, and a back reflector tilt angle equal to 90 degrees minus one half of the aperture 22 tilt angle. For example, at a latitude of about 45 degrees, the aperture 22 tilt angle should be desirably about 45 degrees, while the back reflector 24 tilt angle should desirably be about 67.5 degrees.

For installation convenience, the entire energy-capturing structure illustrated in FIGS. 5A–5B, comprising one glazed aperture 22, two side reflector panels 23, and one back reflector panel 24, can be assembled into a cap for the improved tubular skylight. During installation, this cap can then be rotated, in 90 degree increments, on top of the square tube structure of FIGS. 5A–5B, to aim in the most appropriate direction. To maximize annual energy collection, this direction would normally be generally toward the equator. To maximize energy collection at a specific time of day, the cap could be aimed in another direction; for example, if early morning illumination were most important, the aperture 22 could be aimed toward the east.

EXAMPLE

A prototype, similar in configuration to the embodiment shown in FIGS. 5A–5B, save the absence of extension 21, was tested. For the test prototype, the energy-collection aperture 22 was sized at 12 inches (30 cm) square, and was tilted to the south by 45 degrees, a reasonable angle for the location of the test in Keller, Tex., USA, where the local latitude is 33 degrees. The collimating tube 18 was 36 inches (91 cm) long, with a 12 inch long extension section 19. A translucent white diffuser, known as "White Cracked Ice," was used on the energy-delivering aperture 20, which was sized at 22 inches (56 cm) square. For comparison, a commercially available tubular skylight, of the type taught by DeBlock in U.S. Pat. No. 5,655,339, was purchased and installed next to the prototype. The commercial unit had a clear plastic dome, with prismatic back reflector, on top of a 10 inch (25 cm) diameter tube, whose inner surface used Alcoa EVERBRITE 95® reflector material. The only modification made to the commercial unit was the substitution of the "White Cracked Ice" translucent white diffuser for the diffuser which came with the commercial unit. This substitution was made to allow a more meaningful comparison of the prototype with the commercial skylight, with both equipped with the same diffuser. The length of the commercial skylight tube was selected at 48 inches (122 cm), to be the same as for the prototype of the new collimating skylight.

Figure 6:
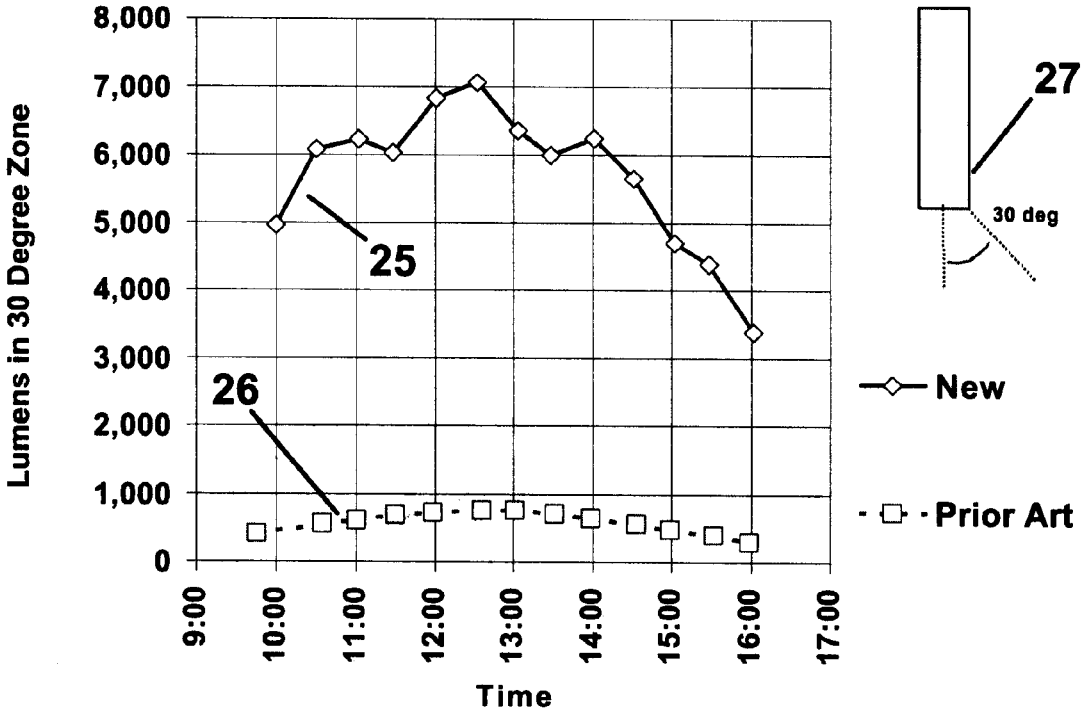
FIG. 6 comprises a graph of measured illumination data for both a prior art tubular skylight and the new collimating tubular skylight of the present invention.

FIG. 6 presents measured illumination data for both passive tubular skylights throughout a clear day of Mar. 3, 1999 at Keller, Tex., USA. The measured value is the total visible flux in lumens, for an angular region within 30 degrees of the optical centerline of the energy-delivering aperture, as shown in the diagram 27. The top curve 25 corresponds to the measurements for the prototype skylight. The bottom curve 26 corresponds to the measurements for the commercial tubular skylight. It should be noted that the tested prototype of the prototype tubular skylight of the present invention utilized an 83% larger energy-collecting aperture than the commercial tubular skylight. However, this aperture difference is small in comparison to the nearly 10×performance advantage of the prototype compared to the commercial skylight. This measured performance superiority clearly shows the substantial advantage offered by the collimating passive tubular skylight over the current state of the art in tubular skylights.

The upper curve 25 shows the illumination provided by the improved skylight, in terms of lumens in an angular region bounded by a 30 degree angle, measured about the periphery of the luminaire of the skylight. The lower curve 26 shows the same illumination measurement for the commercially available tubular skylight. While the prototype had a larger energy-collecting aperture measuring 12 inches (30 cm) square, compared to only 10-inches (25 cm) diameter for the commercial skylight, this area difference is dwarfed by the nearly 10×performance advantage measured for the skylight. The 30 degree angle was selected for the measurement because it corresponds to a floor area slightly larger than 10 feet by 10 feet (3 m by 3 m), centered beneath the skylight luminaire located at a ceiling height of 8 feet (2.4 m). Such a room area is in the appropriate range for an individual tubular skylight with an energy-collecting aperture of about 0.5–1.0 square foot, which each of the tested skylights provided.

PREFERRED EMBODIMENTS—OPERATION

The passive collimating tubular skylight of the present invention functions in the following manner. Sunlight of both direct and diffuse components is collected by an energy-collecting aperture, which is at least partially transparent to the visible portion of the solar spectrum. This energy-collecting aperture can take many forms, from the simple horizontal opening in the top of the skylight 9 as illustrated in FIG. 2B and FIGS. 3A–3D, to the pyramidal window 17 illustrated in FIGS. 4A–4D, to the tilted aperture 22 illustrated FIGS. 5A–5B, to many other skylight aperture types known by those of ordinary skill in the art.

After the sunlight enters the energy-collecting aperture, it moves downward through the light passageway by the combined means of direct transmission and reflection from the inner surface of the passageway. The passageway can take many forms, from the simple conical structure of FIGS. 3A–3D, to the more complex rectangular structure illustrated in FIGS. 4A–4D, to the still more complex structure of FIGS. 5A–5B, to many other passageway structure types known by those of ordinary skill in the art.

Regardless of the complete configuration of the energy passageway, the present invention requires that at least a portion of this light passageway be configured to improve the collimation of the solar rays passing therethrough. Improved collimation is manifested by a reduced angle of emergence of the solar rays exiting the energy-delivering aperture, compared to the angle of incidence of the solar rays entering the energy-collecting aperture. For example, in FIG. 2B, the angle of emergence is 33 degrees, compared to an angle of incidence of 80 degrees, for the solar rays 11 passing through the skylight 9 of the present invention. As an additional example, as illustrated in FIGS. 3A–3D, the maximum value of the angle of emergence is 26 degrees, compared to an angle of incidence of 40 degrees, for solar rays 11 passing through skylight 9 of the present invention. Other solar rays 11 in FIGS. 3A–3D include angles of emergence which are even smaller than 26 degrees, but all the solar ray angles of emergence are significantly smaller than the constant 40 degree angle of incidence of all solar rays. While the solar ray paths are not shown in FIGS. 4A–4D and FIGS. 5A–5B, both embodiments of the skylight of the present invention include collimating sections 18 which will provide the desired reduction in ray emergence angles compared to ray incidence angles.

In all cases, the collimating portion of the skylight of the present invention uses reflection of the solar rays from the interior surfaces of the light passageway as the optical means of improving ray collimation. For example, in the two-dimensional view of the skylight 9 illustrated in FIG. 2B, the tapered light passageway includes a reflective interior surface which is flared outward from the optical axis 12 by approximately 7.9 degrees. The interior surface is specularly reflective for at least the visible portion of the solar rays. The law of reflection requires that each solar ray, when it reflects from the flared interior surface, will have its collimation improved by 15.8 degrees, which is twice the slant angle of the reflective surface compared to the centerline 12. Therefore, after three reflections, the solar rays 11 have an improvement in collimation angle of 47.4 degrees, which is three times the 15.8 degree improvement for a single reflection. Since these rays 11 started their journey through the skylight with an 80 degree angle of incidence compared to the centerline 12, the ray emergence angle is 80 degrees minus 47.4 degrees or 32.6 degrees, which is rounded to 33 degrees in FIG. 2B.

Similarly, the conical reflector 9 illustrated in FIGS. 3A–3D has the same 7.9 degree outward slant compared to the optical centerline of the cone. The solar rays 11 in FIGS. 3A–3D have an angle of incidence of 40 degrees. Due to the three-dimensional nature of the reflective interior surface of the cone 9 in FIGS. 3A–3D, the ray trace is more complicated than for the simplistic two-dimensional case shown in FIG. 2B. To select the proper design, and to accurately estimate the collimation improvement for realistic three-dimensional skylight structures, three-dimensional ray trace analyses must be conducted, as illustrated by the rays 11 in FIGS. 3A–3D. Such ray trace analyses are well known to those of ordinary skill in the art of optical system design. For the specific example of FIGS. 3A–3D, all of the ray emergence angles were inspected to identify the maximum value, which was approximately 26 degrees. While most of the ray emergence angles are smaller than this 26 degree value, all of the emergence angles show a significant collimation improvement over the constant 40 degree incidence angle. Similar three-dimensional ray trace analyses are required to optimize the design and predict the optical performance of other passive collimating tubular skylight geometries, including those embodiments of the invention shown in FIGS. 4A–4D and FIGS. 5A–5B.

After passing through the radiant energy passageway, the light is finally delivered to the interior of the building by an energy-delivering aperture. This energy-delivering aperture can take many forms, from the simple horizontal opening at the bottom of the skylight 9 in FIG. 2B and FIGS. 3A–3D, to the glazed rectangular openings 20 in FIGS. 4A–4D and FIGS. 5A–5B, to many other types of luminaire structures known to those of ordinary skill in the art. Generally, these luminaire structures include a prismatic or translucent diffuser panel to provide a more uniform illumination and to minimize glare from the skylight.

The manufacturing, construction, and installation details of the collimating passive tubular skylight of the present invention are not described herein, as they are not essential to the invention and are further well known to those in the manufacturing, construction, and installation trades. Therefore the non-essential technical details of the skylight construction, including the tapes and sheet metal fasteners which will generally be used to hold the parts of the tube together, are not described herein. Similarly, the specific means of weather-sealing the roof penetration, generally including flashing and s sealants, are not described herein. Likewise, the non-essential glazing details, for both the energy-collecting and the energy-delivering apertures, to both seal the interior volume against dust, dirt, and moisture infiltration, and to improve the aesthetic qualities of the installation, are not described herein. These details have been excluded herein, because their presentation would have detracted from the clear description of the essential features of the new collimating passive tubular skylight.

Accordingly, it can be seen that the present invention provides higher optical performance, greater solar energy capture, better throughput efficiency, improved collimation, and enhanced interior illumination levels, compared to prior art passive tubular skylights.

Although the description above contains many specificities, these should not be construed as limiting the scope of the invention but as merely providing illustrations of some of the presently preferred embodiments of this invention. Various other embodiments and ramifications are possible within its scope. For example, the embodiments shown in FIG. 2B, FIGS. 3A–3D, FIGS. 4A–4D, and FIGS. 5A–5B, all show tubular skylights with vertical principal axes. In many applications, it may be preferable to use a non-vertical principal axis for the improved tubular skylight. In some cases, this axis may be tilted relative to the local vertical direction; in still other cases, this axis may be horizontal; and in still other cases, this axis may be "zig-zag" in configuration to avoid structural elements in the attic of the building.

Similarly, the embodiments illustrated in FIGS. 3A–3D, FIGS. 4A–4D, and FIGS. 5A–5B, all show tubular skylights with round or square light passageways. In many applications, it may be preferable to use rectangular or polygonal or oval light passageways, instead of square or circular ones. Indeed, there may be applications where it proves to be useful to have a combination of passageway cross sectional shapes, with multiple passageway branches and luminaires. Still further embodiments may combine circular passageways with square passageways, with proper transitions between these different passageways, to enable a round energy-collecting aperture to work with a square energy-delivering aperture.

Similarly, only three types of energy-collecting apertures are shown in FIGS. 3A–3D, FIGS. 4A–4D, and FIGS. 5A–5B. Many other apertures are known to those of ordinary skill in the art of skylight apertures, including domes and bubbles and roof windows of almost limitless variation. All of these various roof opening types will perform exceptionally well with the reflective collimating passive tubular skylight of the present invention.

Similarly, the luminaires, or energy-delivering apertures, shown in FIGS. 3A–3D, FIGS. 4A–4D, and FIGS. 5A–5B, are merely example configurations. Many other types of interior luminaires are well known to those of ordinary skill in the art of illumination. For example, luminaires can have three dimensional profiles, including box shapes and hemispherical shapes and cylindrical shapes, wherein their sides are translucent or transparent, as well as their bottoms. All of these luminaire styles will also work exceptionally well with the reflective collimating tubular skylight of the present invention.

Similarly, the various embodiments of the present invention shown in FIG. 2B and FIGS. 4A–4D show a ceiling structure as the location of the luminaire or energy-delivering aperture. Many retail, commercial, industrial, and warehouse buildings do not use interior ceilings. For such applications, the improved passive collimating tubular skylight can be beneficially employed to efficiently deliver illumination to a needed location within the interior of the building, without the need for a ceiling structure of any kind. For example, a suspended tubular skylight, with no surrounding ceiling, can still be utilized to deliver bright, collimated light to a work space or store space within the building. Such radiant energy collimation and transport would be especially beneficial for high-roof buildings, since much of the light from a conventional skylight or roof window would be lost by blockage by trusses and other structures supporting the high roof. Indeed, commercial and retail applications of the skylight may be more numerous than residential applications, and the presence or absence of a ceiling is unimportant to the function of the present invention.

Furthermore, while the preferred embodiments shown in FIG. 2B, FIGS. 3A–3D, FIGS. 4A–4D, and FIGS. 5A–5B, show only one skylight structure, it should be apparent to those skilled in the art that a plurality of such skylights can be integrated together, perhaps with energy-collecting apertures facing different directions, with potential savings in materials and improvements in performance due to such integration. Such multi-skylight systems also form an integral part of the invention.

While many different embodiments are presented for the passive collimating tubular skylight of the present invention, several key geometrical and physical features are necessarily present in each embodiment. In this connection, the passive collimating tubular skylight of the present invention must include a tapered collimating section with a specularly reflective interior surface. This tapered collimating section has one smaller aperture for receiving incoming light and a second larger aperture for delivering outgoing light. The length of this collimating section is defined by the distance between the smaller aperture and the larger aperture. While the relative areas of the two apertures, and the length of the collimating section between them, are best optimized by parametric ray trace analyses, as discussed elsewhere in this specification, the second larger aperture of the collimating section is always at least 15% larger in area than the first smaller aperture. Also, the length of the collimating section is always larger than 60% of the smallest extent (e.g., width or diameter) of the first smaller aperture.

Furthermore, the collimating section is always able to accept light rays from a range of incidence angles, relative to a line drawn normal to a plane defined by the first smaller aperture, and deliver the light rays in a range of emergence angles relative to a line drawn normal to a plane defined by the second larger aperture, where the emergence angle range is significantly smaller than the incidence angle range. This reduction in the angular range of delivered rays compared to incoming rays leads to substantial improvements in both optical throughput efficiency for the tubular skylight and in light distribution from the luminaire.

Various, specific configurations of the passive collimating tubular skylight will be useful for various, specific applications. These specific configurations will depend on application—specific considerations, including the following:

The desired incoming solar ray acceptance angle range at the energy-collecting aperture. For example, ray incidence angles from zero to 90 degrees, relative to a line drawn normal to a plane defined by the energy-collecting aperture area, if all diffuse and direct sunlight is desired to be captured;

The desired outgoing solar ray collimation angle range at the luminaire. For example, ray emergence angles (or collimation angles) from zero to 30 degrees, relative to a line drawn normal to a plane defined by the luminaire aperture, to prevent rays from leaving the luminaire in the glare angle range;

The ratio of the energy-delivering aperture width or diameter (W2), to the energy collecting aperture width or diameter (W1) which must exceed the minimum ratio required by the second law of thermodynamics, namely W2/W1>sin(MAX INCIDENCE ANGLE)/sin (MAX COLLIMATION ANGLE);

The length of the collimation section must ensure that rays to be collimated intercept the sidewalls at least once, and are thereby reflectively collimated. This relationship requires that the length L be at least equal to (W1+W2)/(2 tan(MAX COLLIMATION ANGLE)). For a greater number of reflections, the length, L, should be greater; and Due to the three-dimensional nature of the optical design problem, the preferred method of optimizing the geometry of the specularly reflective collimation section is by ray tracing, wherein solar rays from all desired acceptance angle directions are traced upon entry to all portions of the energy-collecting aperture down through the collimation section until they exit the energy-delivering aperture. Such ray tracing is done for a number of candidate configurations, comprising a matrix of W1, W2, and L values, and other parameters (e.g., specular reflectivity of the surface, total lumens desired to be delivered, possible curvature of the collimation surfaces, the type, geometry, and glazing of the energy collecting aperture above the roof of the building, the type and transmittance properties of the diffuser in the luminaire within the building, etc.), and the collimation section configuration which provides the best overall optical performance is selected, provided that this configuration is consistent with the economical use of materials and labor. Such ray tracing is well know to persons of ordinary skill in the art of tubular skylights.

While the preferred embodiments of the reflective collimating tubular skylight described above relate to building interior illumination systems, there may be other applications of the collimating skylight beyond simple illumination. For example, by using appropriate optical materials or coatings for the glazings and/or the reflective components of the skylight, spectrally selective collimated illumination may be provided. Thus, if a collimated light source within a specific wavelength bandwidth were desired, the passive collimating tubular skylight could provide such a light source, through the proper optical processing of the incident sunlight.

What is claimed is:

1. A reflective, collimating tubular skylight system comprising:

a radiant energy collecting aperture having at least a minimum width $W_1$ and a given area $A_1$;

a radiant energy delivering aperture having a given area $A_2$; and a connecting passageway including a collimating section having a given length L, where said connecting passageway is disposed between said energy collecting aperture and said energy delivering aperture;

said collimating section including a specularly reflective interior surface for a substantial portion of its length;

where the area $A_1$ of said energy collecting aperture is at least 15% smaller than the area $A_2$ of said energy delivering aperture; and where said length L of said collimating section exceeds 60% of said width $W_1$.

2. The skylight system of claim 1 wherein said passageway has a larger opening near said radiant energy-delivering aperture than near said radiant energy-collecting aperture.

3. The skylight system of claim 1 wherein said passageway has a cross-sectional shape at least partially bounded by linear segments.

4. The skylight system of claim 1 wherein said passageway has a cross-sectional shape at least partially defined by a rectangle.

5. The skylight system of claim 1 wherein said passageway has a cross-sectional shape at least partially bounded by curved line segments.

6. The skylight system of claim 1 wherein said radiant energy-collecting aperture is located above the roof of a building and said radiant energy-delivering aperture is located in the interior space of said building.

7. The skylight system of claim 6 wherein said radiant energy-collecting aperture is oriented to maximize solar energy interception during a time period in order to achieve maximum interior illumination.

8. A tubular skylight adapted for use in a structure which includes a surface which defines an interior and exterior space where said skylight is adapted to selectively collect and transmit radiant energy comprising:

a radiant energy collecting aperture adapted to collect radiant energy from a first range of directions defined by the range of collected ray incidence angles as measured from a line drawn normal to a plane defined by said energy-collecting aperture where said energy-collecting aperture defines a cross sectional area $A_1$;

a radiant energy delivering aperture defining a cross sectional area $A_2$, where $A_2$ is at least 15% greater than $A_1$; and a radiant energy passageway disposed between and operably couple to said energy collecting aperture and said energy delivering aperture, said passageway including a collimating section having a specularly reflective interior surface to reflect radiant energy received through said energy collecting aperture, where said collimating section is adapted to restrictively redirect radiant energy passing through said energy delivering aperture into a second range of directions defined by the range of delivered ray emergence angles as measured from a line drawn normal to a plane defined by said energy-delivering aperture, where said first range is larger than said second range and said second range radiates rays at less than sixty degree emergence angle.

9. The skylight of claim 8 wherein said passageway has a larger cross-sectional area near said energy-delivering aperture than near said energy-collecting aperture.

10. The skylight of claim 8 wherein the specularly reflective surface of said collimating section is configured to reduce the divergence angle of the radiant energy as said radiant energy reflects from said reflective inner surface.

11. The skylight of claim 8 wherein at least a portion of said passageway is tapered from a smaller passageway opening near said radiant energy-collecting aperture to a larger passageway opening near said radiant energy-delivering aperture.

12. The skylight of claim 8 wherein said energy collecting and energy delivering apertures and said passageway together enclose a volume of space, where said volume is generally sealed to minimize infiltration of dirt, dust, or moisture into said volume.

13. The skylight of claim 8 wherein said radiant energy-collecting aperture is adapted to be oriented to maximize the quantity of radiant energy collected during time periods in order to achieve maximum interior illumination.

14. The skylight of claim 8 wherein said passageway has at least one tapered portion for collimation and at least one non-tapered portion for extending the length of the passageway.

15. The skylight of claim 8 wherein said radiant energy-collecting aperture is adapted to be at least partially oriented toward the Earth's equator, and includes at least one reflective interior surface to direct said radiant energy into said passageway.

16. A reflective collimating skylight system comprising:

at least one radiant energy collecting aperture having minimum width $W_1$ and a given cross section area $A_1$;

at least one radiant energy delivering aperture having a given cross sectional area $A_2$, where $A_2$ is at least 15% greater than $A_1$;

at least one radiant energy passageway disposed between said energy collecting and said energy delivering apertures so as to transmit radiant energy from said radiant energy collecting aperture to said radiant energy delivering aperture;

said radiant energy passageway includes a collimating section proximate said energy collimating aperture where said collimating section includes a specularly reflective inner surface;

said collimating section including a length L which is greater than 60% of $W_1$.

17. The skylight system of claim 16 wherein said passageway includes at least one portion with a variable cross-sectional area which becomes larger near said energy-delivering aperture than near said energy-collecting aperture.

18. The skylight system of claim 16 wherein said radiant energy passageway includes a specularly reflective interior surface configured to reduce the divergence angle of said solar radiation as said radiation reflects off of its interior surface while said radiation proceeds from said radiant energy-collecting aperture to said radiant energy-delivering aperture.

19. The skylight system of claim 16 wherein said radiant energy passageway includes at least one portion of variable cross sectional area and at least one portion of generally constant cross sectional area.

20. A method of fabricating a collimating skylight comprising the steps of:

positioning a radiant, energy collecting aperture having a minimum width $W_1$ and a given cross sectional area $A_1$ relative to a radiant, energy delivering aperture having a width $W_2$ and a cross sectional area $A_2$ in a spaced apart relation where the distance between said energy collecting aperture and said energy delivering aperture is a distance L and where $W_2$ is larger than $W_1$;

positioning at least one specularly reflective, radiant energy delivering passageway between said energy collecting aperture and said energy delivering aperture where the length of said passageway is substantially equal to L; and configuring such passageway such that radiant energy entering said energy collecting aperture will be reflectively collimated through said passageway to said energy delivering aperture, further including the step of making the length L at least 60% of the minimum width $W_1$ of the energy collecting aperture.

21. The method of claim 20 further including the steps of making the cross sectional area $A_1$, of the energy collecting aperture at least 15% smaller than the cross sectional area $A_2$ of the energy delivering aperture.

22. The method of claim 20 where the configuration of the passageway is determined as a function of the desired maximum incoming solar ray angle incidence angle $T_1$ at the energy collecting aperture and the desired maximum outgoing solar ray collimation angle $T_2$ at the energy delivering aperture, where said function is defined by the inequalities:

(1) $W_2/W_1 > \sin(T_1)/\sin(T_2)$; and (2) $L > (W_1+W_2)/(2 \tan(T_2))$.

23. The method of claim 20 further including the step of orienting the radiant energy collecting aperture so as to maximize solar energy interception during a time period when interior illumination is desired.

24. The method of claim 20 further including the step of including a second, non tapered passageway between said first passageway and said radiant energy delivering aperture.

25. The method of claim 20 further including the step of including in said passageway a section having a variable, cross sectional area.

26. A tubular skylight including the following elements:

an energy-collecting aperture;

an energy-delivering aperture;

a specularly reflective light passageway having a length L disposed between said energy-collecting and energy-delivering apertures;

said light passageway including a specularly reflective collimating section;

said collimating section having a first width $W_1$ and a first cross sectional area $A_1$ for accepting light from said energy-collecting aperture;

said collimating section having a second width $W_2$ and a second cross sectional area $A_2$ for delivering light to said energy-delivering aperture; and where $A_2$ is at least 15% larger than $A_1$ and where the configuration of the passageway is determined as a function of the desired maximum incoming solar ray angle incidence angle $T_1$ at the energy collecting aperture and the desired maximum outgoing solar ray collimation angle $T_2$ at the energy delivering aperture, where said function is defined by the inequalities:

(1) $W_2/W_1 > \sin(T_1)/\sin(T_2)$; and (2) $L > (W_1+W_2)/(2 \tan(T_2))$.

27. A method of fabricating a collimating skylight comprising the steps of:

positioning a radiant, energy collecting aperture having a minimum width $W_1$ and a given cross sectional area $A_1$ relative to a radiant, energy delivering aperture having a width $W_2$ and a cross sectional area $A_2$ in a spaced apart relation where the distance between said energy collecting aperture and said energy delivering aperture is a distance L and where $W_2$ is larger than $W_1$;

positioning at least one specularly reflective, radiant energy delivering passageway between said energy collecting aperture and said energy delivering aperture where the length of said passageway is substantially equal to L; and configuring such passageway such that radiant energy entering said energy collecting aperture will be reflectively collimated through said passageway to said energy delivering aperture, where the configuration of the passageway is determined as a function of the desired incoming solar ray angle incidence angle $T_1$ at the energy collimating aperture and the desired maximum outgoing solar ray collimation angle $T_2$ at the energy delivering aperture, where said function is defined by the inequalities:

(1) $W_2/W_1 > \sin(T_1)/\sin(T_2)$; and (2) $L > (W_1+W_2)/(2 \tan(T_2))$.

* * * * *